US009021797B2

(12) United States Patent
Scheffel

(10) Patent No.: US 9,021,797 B2
(45) Date of Patent: May 5, 2015

(54) ENERGY-EFFICIENT HYDRAULIC DRIVE FOR THE LINEAR MOVEMENT OF A MASS

(75) Inventor: Gerd Scheffel, Korschenbroich (DE)

(73) Assignee: Parker Hannifin Manufacturing Germany GmbH & Co. KG, Bielefeld (DE)

( * ) Notice: Subject to any disclaimer, the term of this patent is extended or adjusted under 35 U.S.C. 154(b) by 649 days.

(21) Appl. No.: 13/342,262

(22) Filed: Jan. 3, 2012

(65) Prior Publication Data

US 2012/0192553 A1 Aug. 2, 2012

(30) Foreign Application Priority Data

Jan. 8, 2011 (DE) ..... 10 2011 008 145

(51) Int. Cl.

| | |
|---|---|
| ***F15B 1/027*** | (2006.01) |
| ***F15B 21/14*** | (2006.01) |
| ***F15B 1/02*** | (2006.01) |
| ***F15B 11/22*** | (2006.01) |

(52) U.S. Cl.

CPC ..... *F15B 21/14* (2013.01); *F15B 1/024* (2013.01); *F15B 2211/212* (2013.01); *F15B 2211/30575* (2013.01); *F15B 2211/3059* (2013.01); *F15B 2211/7053* (2013.01); *F15B 2211/7107* (2013.01); *F15B 2211/88* (2013.01); *F15B 11/22* (2013.01); *F15B 2211/3058* (2013.01); *F15B 2211/7054* (2013.01); *F15B 2211/851* (2013.01); *F15B 2211/853* (2013.01)

(58) Field of Classification Search

CPC ..... F15B 1/024; F15B 11/22; F15B 21/14; F15B 2211/212; F15B 2211/853; F15B 2211/3058; F15B 2211/851; F15B 2211/30575; F15B 2211/7053; F15B 2211/88; F15B 2211/7054; F15B 2211/7107

USPC ..... 60/413, 414, 417, 426; 91/509, 510

See application file for complete search history.

(56) References Cited

U.S. PATENT DOCUMENTS

| | | | | |
|---|---|---|---|---|
| 7,434,391 | B2 * | 10/2008 | Asam et al. | 60/414 |
| 2013/0333378 | A1 * | 12/2013 | Wen | 60/593 |

* cited by examiner

*Primary Examiner* — Dwayne J White
*Assistant Examiner* — Logan Kraft
(74) *Attorney, Agent, or Firm* — Renner, Otto, Boisselle & Sklar, LLP

(57) ABSTRACT

Hydraulically driven arrangement for the linear movement of a mass body consisting of two double acting cylinders coupled in parallel, whereby one operating cylinder is a control cylinder for controlling the movement of the mass body, which is split into an acceleration phase, a movement phase and a brake phase. The other operating cylinder is connected as a drive cylinder to the hydraulic power pack as an energy storage, in a manner that the power pack during the acceleration phase of the mass body generates the drive energy for the drive cylinder, and the drive cylinder in the brake phase of the mass body, which serves as a pump for charging the hydraulic power pack. The control cylinder and drive cylinder each have a piston with a one-sided piston rod coupled to the mass body. The control cylinder and the drive cylinder are controlled by hydraulically separated, independent control circuits.

13 Claims, 8 Drawing Sheets

ENERGY-EFFICIENT HYDRAULIC DRIVE FOR THE LINEAR MOVEMENT OF A MASS

Figure 1:
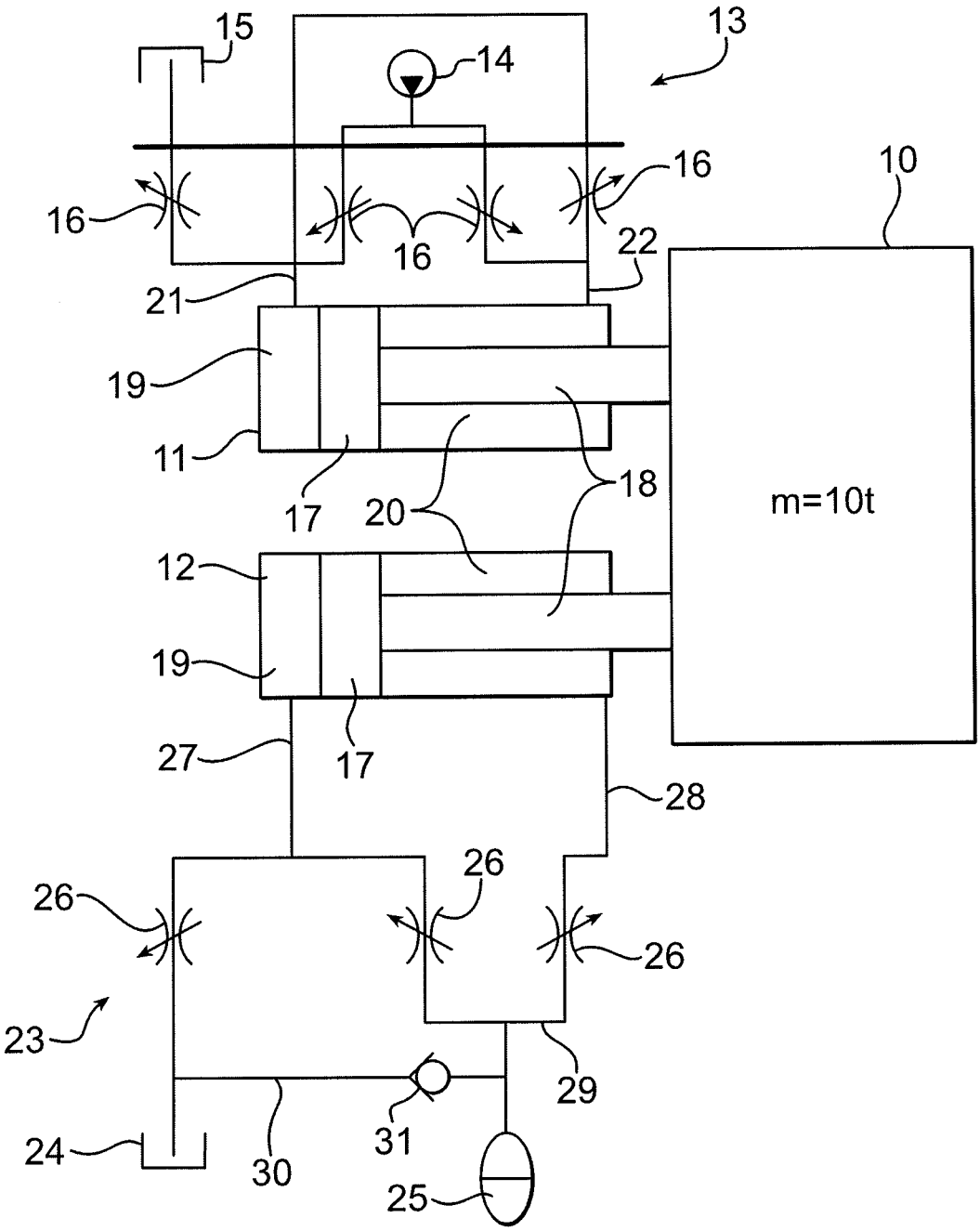

The invention applies to a hydraulically-driven arrangement for the linear movement of a mass body. It consists of two double acting operating cylinders coupled to each other in parallel, each piston with at least one piston rod set up to interact with the mass body, whereby one operating cylinder is set up as a control cylinder for controlling the movement of the mass body, which is split into the acceleration phase, the movement phase and brake phase. The other operating cylinder is connected as a drive cylinder to the hydraulic power pack as an energy store, in such a way that the power pack during the acceleration phase of the mass body generates the drive energy for the drive cylinder, and the drive cylinder in the brake phase of the mass body serves as a pump for charging the hydraulic power pack.

Such an arrangement with the previously mentioned features is known from WO 93/11363 A1. The device described therein applies to a hydraulically operated machine that brings about the raising and lowering of the work equipment by means of a double acting operating cylinder with a one-sided piston rod coupled to the work equipment.

To recover the potential energy of this work equipment in the raised position, the drive cylinder, which is the drive cylinder for moving the work equipment, is connected with its rod-less large cylinder capacity to a hydraulic power pack. This power pack on one hand feeds the stored energy into the operating cylinder when the work equipment is raised, and on the other hand, when lowering the work equipment, the power pack is charged through the fluid displaced by the rod less cylinder capacity of the operating cylinder. Due to the built-up pressure, it serves additionally as a brake for the movement of the piston in the drive cylinder and consequently for the work equipment. A control cylinder, with a similar design to the drive cylinder, is connected to a pump parallel to the drive cylinder, for controlling the movement of the work equipment. Both rod-side smaller cylinder capacities of the drive cylinder and the control cylinder are coupled to each other with a fluid bearing connection, and are together connected to a hydraulic control circuit. This is supposed to achieve that, when lowering the work equipment, the displaced fluid from the rod smaller cylinder capacity of the operating cylinder is completely fed into the power pack.

A similar arrangement of two operating cylinders is described in DE 103 15 071 A1. Here, two double acting operating cylinders are coupled with a one-sided piston rod in parallel arrangement with reciprocal application to a jointed arrangement of a work tool. Each operating cylinder is, via direction control valves, coupled to a pump and a power pack, so that on piston thrust, the fluid dispersed by the power pack will supplement or replace the fluid flow provided by the pump.

The power pack is recharged by the corresponding reverse movement of the pistons of the two operating cylinders. Therefore, the operating cylinders, as well as pump and power pack, are connected to a standard hydraulic control circuit.

Finally, the hydraulic drive for an injection mold machine or press is planned, as is known from DE 10 2005 017 878 B3, in which at least a first and a second drive cylinder. The first drive cylinder is connected to a control circuit with a pump, while the second drive cylinder is connected to a power pack that can be engaged as required.

The known arrangements are particularly disadvantageous in that the energy recovery is only possible in one movement direction of the operating cylinder piston, the back stroke, and accordingly the saved energy can only be used on the forward piston stroke. Consequently, the design of this hydraulic drive cannot be applied to application purposes that relate to a back and forth movement of a large mass into two moving directions.

Such an application purpose results from DE 10 2008 059 436 B3 for example, which describes a hydraulic control valve for a one-sided operating differential cylinder. Such a piston with one-sided piston rod, demonstrating a double acting operating cylinder, is used for linear movement of a mass body such as the inlet and pressure flap in plastic injection machines, where the piston rod of the operating cylinder for driving the mass body is coupled to the mass body. Via the control valve described in DE 10 2008 059 436 B3, the forward drive is controlled by driving in of the piston rod and the reverse drive is controlled by returning the piston rod, whereby each movement encompasses an acceleration phase, movement phase and brake phase to reach the end position of the mass body. As far as the differently sized cylinder capacities of the operating cylinder can be connected to a pump or a reservoir via the interconnected control valve, described in detail in DE 10 2008 059 436 B3, which is equipped with an recovery system which will directly feed the fluid displaced from the small cylinder capacity when the operating cylinder piston moves forward, to the large cylinder capacity and thus relieve the pump.

As far as the mass bodies to be moved by such an operating cylinder can have a mass of for example ten tons or more, there are significant movement requirements put on the design of the operating cylinder that must provide the corresponding actuating force. Especially when braking a mass body subsequent to its moving phase, there is significant loss of unused power as at the start of the following acceleration phase, the hydraulic supply system must make the entire movement energy available to the operating cylinder.

The aim of the invention is to make available a hydraulically-driven arrangement with energy recovery for the linear movement of a mass body (according to DE 10 2008 059 436 B3) in both moving directions according to the type features.

The solution to this task is provided in different designs of the invention from the ancillary claims 1 and 2; advantageous designs and further embodiments of the inventions are listed in the sub-claims.

A first design of this invention intends that a control cylinder and drive cylinder, each by means of hydraulically separate, independent control circuits, controlled by one control valve or a control valve arrangement, are provided for a piston with a one-sided piston rod coupled to the mass body for the back and forth movement of the mass body. The control valve arrangement assigned to the drive cylinder demonstrates three control edges, and the small cylinder capacity of the drive cylinder can be coupled via the control valve arrangement, either to the power pack or the reservoir.

In a second design of the invention, the control cylinder and drive cylinder will each have one piston with piston rods on both sides for symmetrical piston surfaces, of which one piston rod each, in terms of the back and forth movement of the mass body, is coupled to the mass body. For adjustment to arrangement it is planned that the control cylinder and drive cylinder are each separately hydraulically controlled using control circuits of one control valve each, or a control valve arrangement. The control valve arrangement assigned to the drive cylinder has four control edges and the small cylinder capacity, as well as the large cylinder capacity of the drive cylinder, can be connected via the control valve arrangements either with the power pack or the reservoir.

The advantage of the invention is that, due to the separation of the hydraulic control circuits of the control cylinder and drive cylinder, the storage of the kinetic movement energy of the mass body is possible and the saved energy can be used to drive the mass body in both directions. Here, the control circuit for controlling the drive cylinder results in charging of the power pack in both moving directions of the pistons in the drive cylinder. During the movement phase occurring between the acceleration phase and the brake phase, the drive cylinder will not need to convey additional drive energy; the movement thrust conveyed by the control cylinder is sufficient. When designing the control cylinder and drive cylinder their piston areas should together correspond approximately to the piston area of a single operating cylinder according to the state of the art technology, so that the control cylinder and drive cylinder can be configured with smaller dimensions in comparison to the state of the art technology. This too achieves corresponding savings.

After executing an example of the invention, it is initially intended that the cylinder capacities of the control cylinder be connected to a pump and/or reservoir via a hydraulic control valve, as is known from the basic principle already addressed in DE 10 2008 059 436 B3 for an operating cylinder as sole drive source for a mass body. It is planned, especially after executing an example of the invention that the hydraulic control valve has a recovery feed control for the fluid dispersed during the piston movement from the small cylinder capacity of the control cylinder, as is known in detail from the mentioned DE 10 2008 059 436 B3, and is therefore state of the art technology.

To use the operating cylinder parallel switched to the control cylinder, it is intended according to an executed example of the invention that the cylinder capacities of the drive cylinders can be connected via the hydraulic control valve arrangement either with the power pack and/or a reservoir.

In order to also realize the recovery feed control for the control of the drive cylinder, with feeding the fluid dispersed from one cylinder capacity to the other cylinder capacity of the drive cylinder, it is intended, according to the executed example of the invention, to include a flow line connecting the cylinder capacities of the drive cylinder between the power pack and its connection with the control edges of the control valve arrangement. As part of the control design planned for an operating cylinder with a one-side piston rod, it can be planned in that on the outstroke of the piston rods of the control cylinder and drive cylinder during the acceleration phase of the mass body, the connection is opened between the power pack filled with the pre-loaded fluid and the large cylinder capacity of the drive cylinder via the allocated control edge of the control valve arrangement. At the same time the connection between the small cylinder capacity of the drive cylinder and the flow line is opened, so that the fluid stored in the power pack and the fluid dispersed during the piston movement from the small cylinder capacity of the drive cylinder is fed to the large cylinder capacity of the drive cylinder, and in which during the brake phase of the mass body on one hand the connection is opened between the large cylinder capacity of the drive cylinder and the reservoir. At the same time the connection between the flow line and the large cylinder capacity of the drive cylinder is blocked and, on the other hand the connection between the small cylinder capacity of the drive cylinder and the flow line remains open with the power pack connected to it, so that the power pack is charged As far as in this design form of the invention, the piston rod of the control cylinder and drive cylinder is moved backwards through the return movement of the mass body. As part of this design it is planned that during the acceleration phase of the mass body, the connection between the large cylinder capacity of the drive cylinder to the tank is open, while simultaneously closing the connection to the power pack, and the connection between the power pack and the small cylinder capacity of the drive cylinder is opened. Thus the fluid dispersed from the power pack charges the small cylinder capacity of the drive cylinder. During the brake phase of the mass body the connection between the large cylinder capacity of the drive cylinder and the flow through line connected with the power pack is opened so that the power pack is charged by the fluid dispersed from the large cylinder capacity of the drive cylinder.

As already mentioned, the drive cylinder is only needed during the acceleration phase and brake phase of the mass body. During the movement phase the drive via the control cylinder is sufficient to maintain the movement speed of the mass body. Based on this background, according to a practical embodiment of the invention, it is foreseen that on both ends of the linear movement path of the mass body one drive cylinder each is arranged with a hydraulic control, with its connections to the power pack and reservoir. Its piston rods facing the mass body only interact during the brake and acceleration phase of the mass body, whereas the respective piston rod of the control cylinder is coupled to the mass body throughout its entire movement path. This embodiment has the further advantage that both drive cylinders only need to be comparatively small, since only short acceleration paths or brake paths are present and therefore only short piston rods need to be provided. This also results in a small construction volume.

As part of such a practical embodiment of the invention it can be planned that a controllable power pack is allocated to each of the two drive cylinders via an interconnected control valve arrangement. Alternatively, it can be planned that the two drive cylinders are connected to a joint power pack via the allocated control valve arrangement.

According to the practical embodiment of the invention it is planned that the control valve arrangement for the control of the drive cylinders is formed by 2/2-way valves in the lines leading from the cylinder capacities of the drive cylinders to the power pack and the reservoir. Alternatively, the control valve arrangement for the control of the drive cylinder can consist of a piston slide valve connected the cylinder capacities and the tank and power pack. Any other embodiment of a functional hydraulic control valve can be implemented.

The drawing reflects the practical embodiments of the inventions which are described below. The following is shown:

FIG. 1 A hydraulic drive arrangement for a mass body with two operating cylinders each with a piston with one-sided piston rod in a schematic diagram of a hydraulic circuit diagram.

Figure 2:
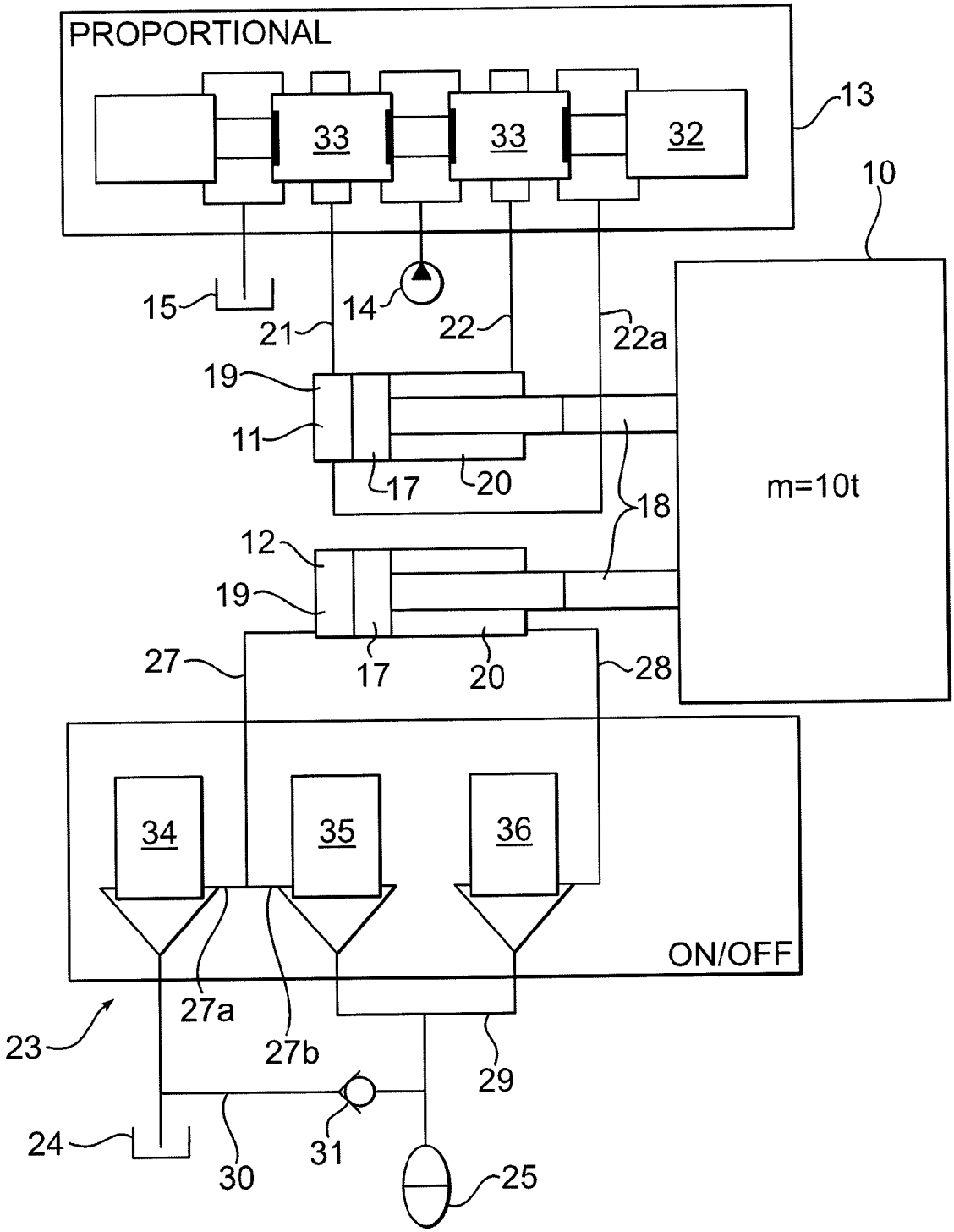

FIG. 2 The drive arrangement according to FIG. 1 in a schematic diagram of an allocated control valve arrangement when the mass body is idle before initiating its movement.

Figure 3:
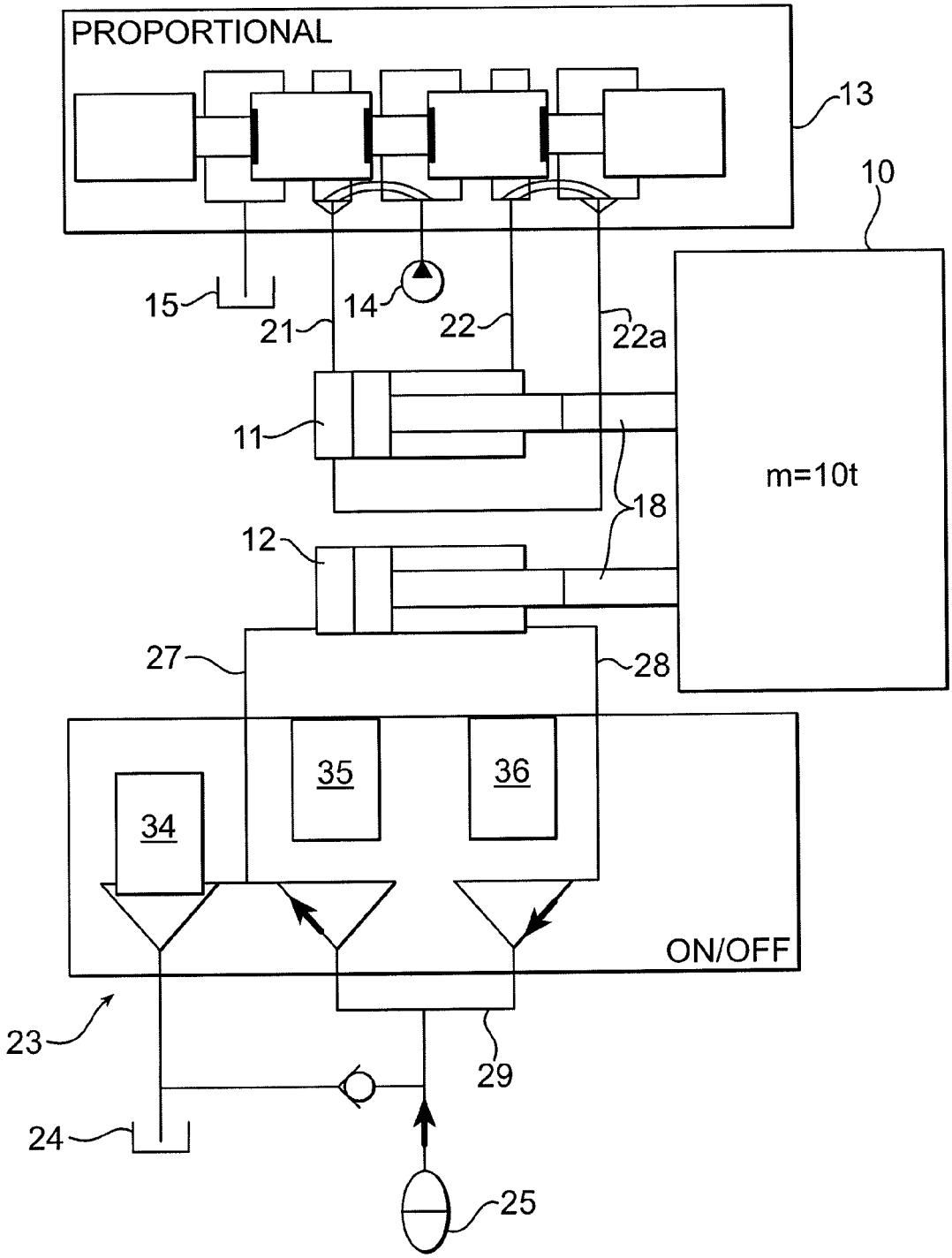

FIG. 3 The drive arrangement according to FIG. 2 in a switch position during the acceleration phase of the mass body when the mass body is moving forward.

Figure 4:
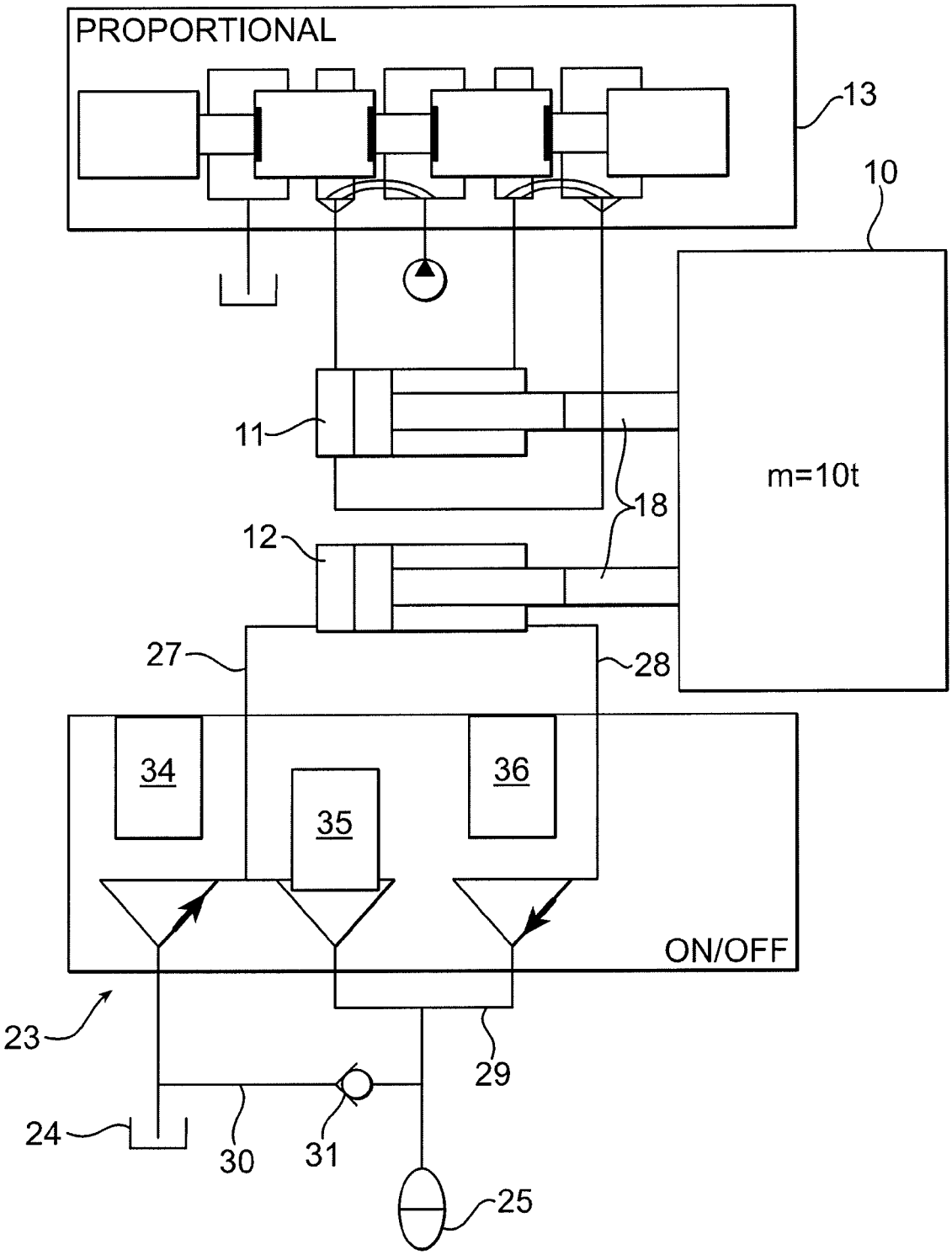

FIG. 4 The drive arrangement according to FIG. 3 in the switch position during the brake phase of the mass body.

Figure 5:
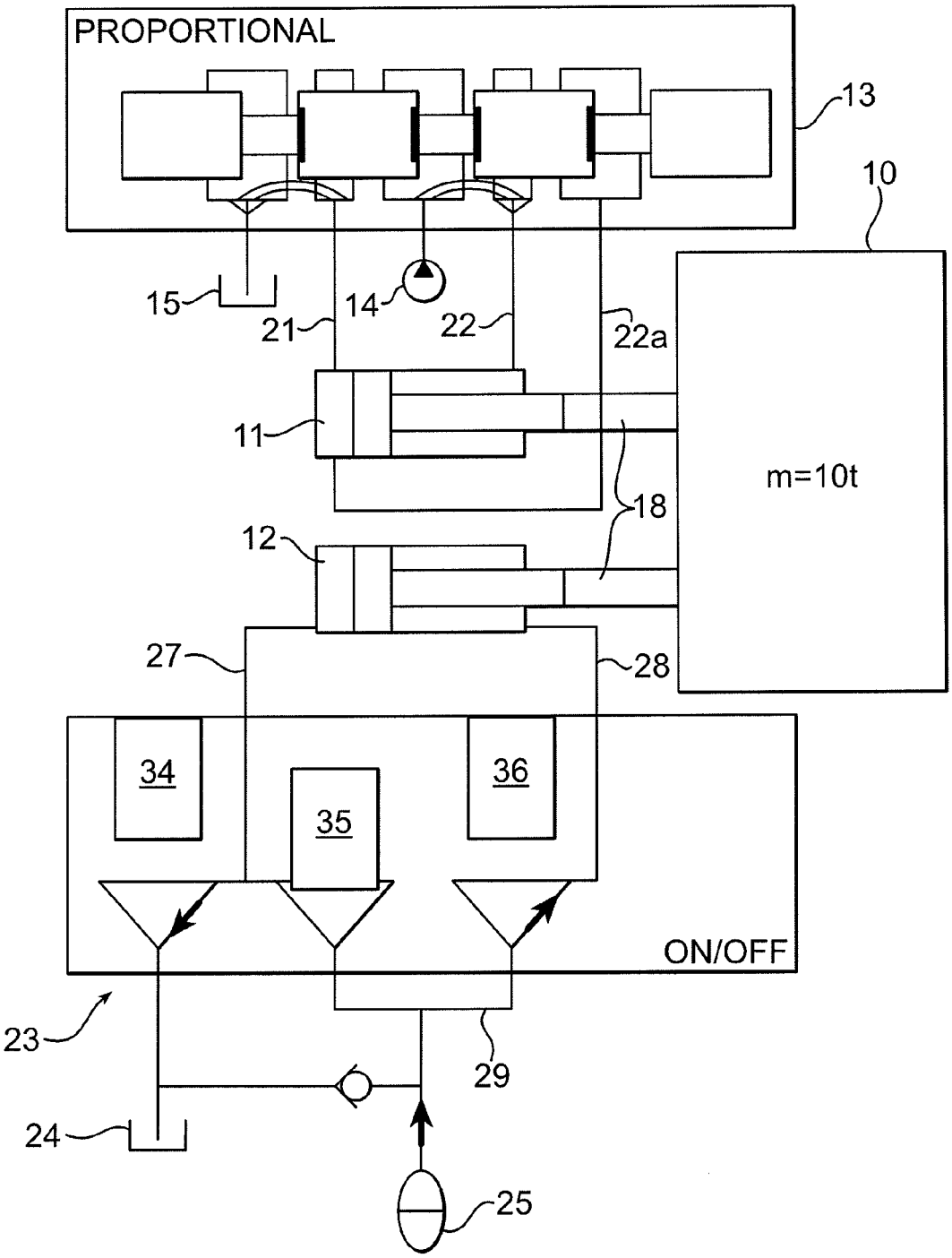

FIG. 5 The drive arrangement according to FIG. 3 in a switch position during the acceleration phase of the mass body when the mass body is moving backward.

Figure 6:
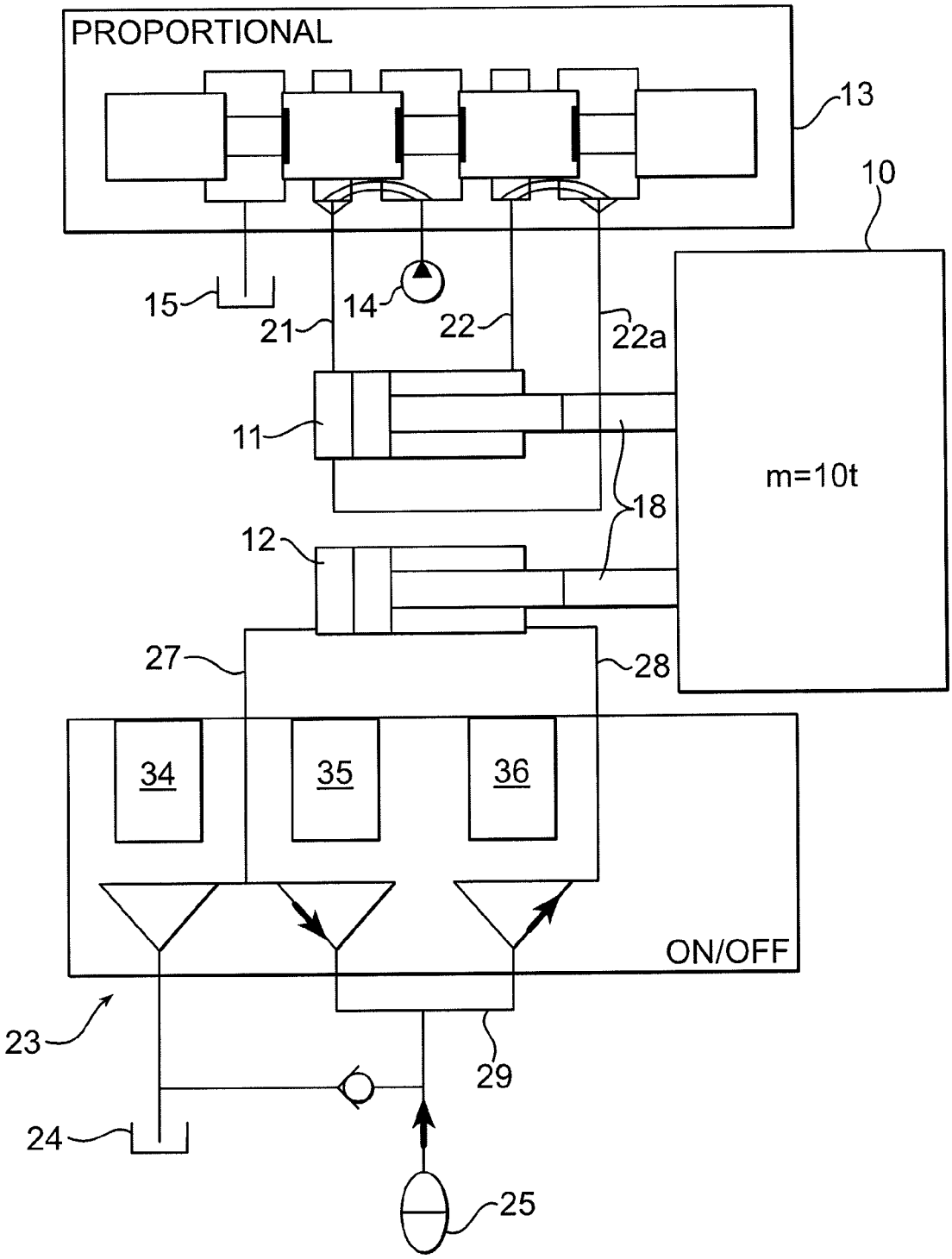

FIG. 6 The drive arrangement according to FIG. 5 in the switch position during the brake phase of the mass body.

Figure 7:
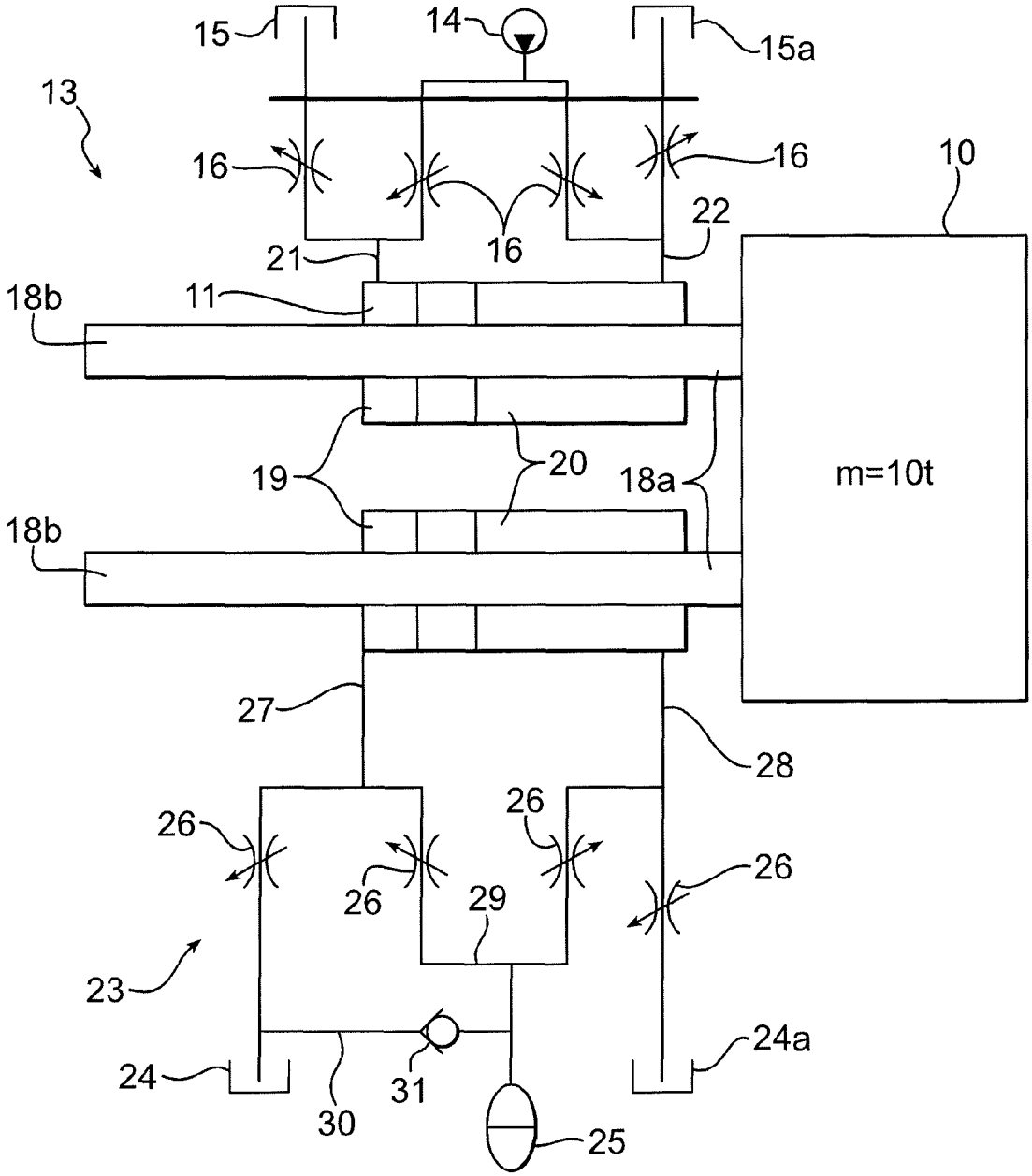
Figure 8:
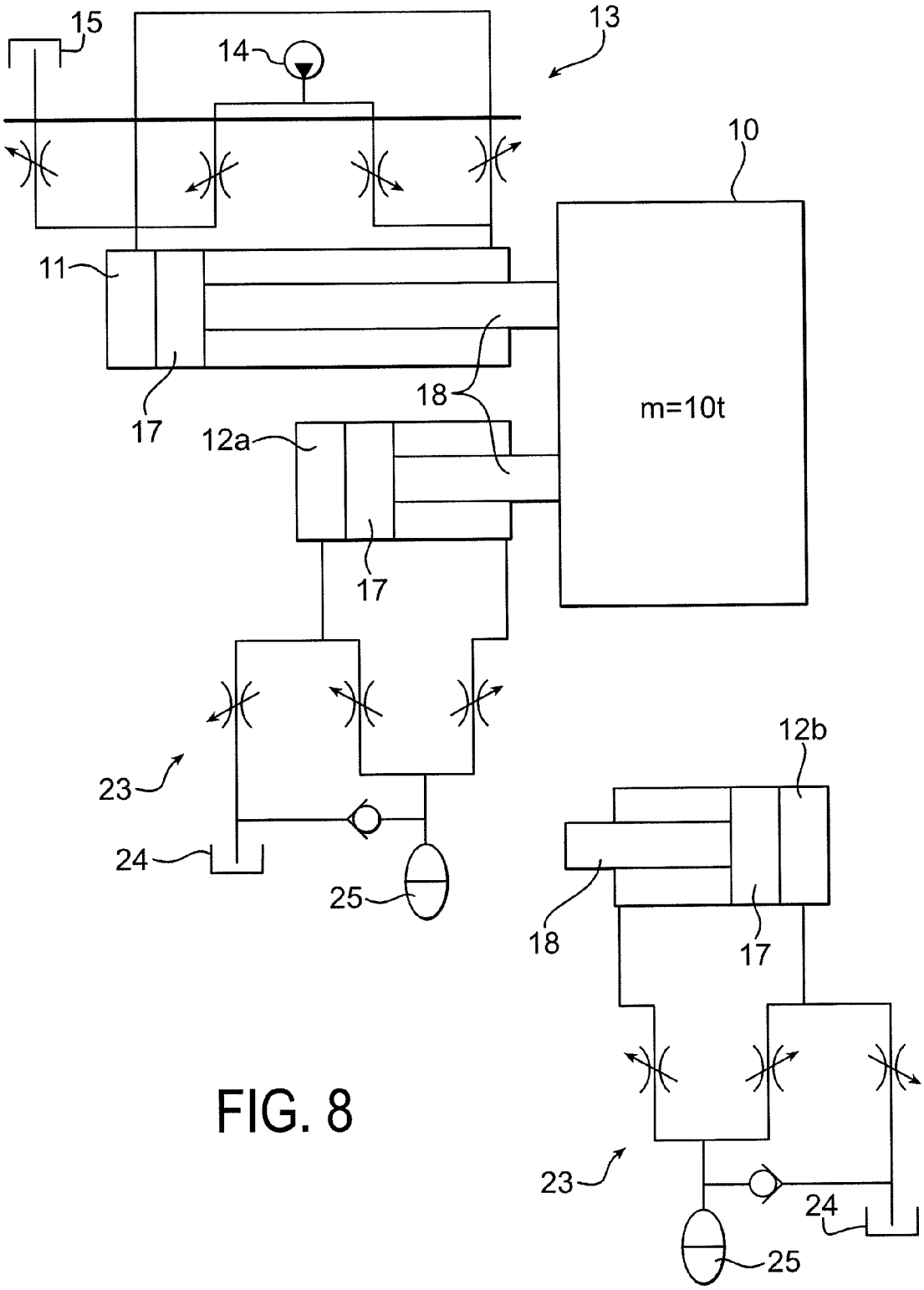

FIG. 7 Another practical embodiment of the drive arrangement according to FIG. 1 with operating cylinders with piston rods on both sides of the piston FIG. 8 A practical embodiment of the drive arrangement according to FIG. 1 with a control cylinder and two drive cylinders arranged on both ends of the linear movement path of the mass body, and applicable hydraulic controls.

To control the back and forth movement of a mass body 10, seen in FIG. 1, in terms of its forward movement it is associated with extending the piston rods and its backward movement with retracting the piston rods, two parallel switched operating cylinders are planned of which one operating cylinder is established as the control cylinder 11 and the other operating cylinder as drive cylinder 12. Both cylinders 11, 12 are designed as one-sided cylinder with one piston 17 with a connected piston rod 18 coupled to the mass body, so that in the respective cylinders 11, 12 one large cylinder capacity 19 and a smaller cylinder capacity 20 result.

For the control, the control cylinder 11 is connected to the control valve 13, whereby the lines 21 or 22 each leading from the large cylinder capacity 19 and the smaller cylinder capacity 20 are connected to a pump 14 or a reservoir 15 via the respective connections of the control valve 13, and the four control edges 16 designed in the control valve. To produce the recovery feed control already described in DE 10 2008 059 436 B3, a further pipe 22*a* is planned from the control valve 13 to the large cylinder capacity 19 of the control cylinder 11, which, via the allocated position of the control valve 13, directly connects the small cylinder capacity 20 of the control cylinder 11 to its large cylinder capacity 29.

Accordingly, a control valve arrangement 23 is allocated to the drive cylinder 12 where the connections are connected via the lines 27 or 28 to its large cylinder capacity 19, and its small cylinder capacity 20. Further, the connections of the control valve arrangement 23 are connected to a tank 24 or to a hydraulic power pack 25. Three control edges 26 are arranged in the control valve arrangement 23 in such a way that the small cylinder capacity 20 of the drive cylinder 12 is connected to the power pack 25, and the large cylinder capacity 19 is optionally connected to the power pack 25 or the reservoir 24. For this the line 27 leading from the large cylinder capacity 19 of the drive cylinder 12 to the control valve arrangement 23 branches into two lines 27*a* and 27*b*, which lead to the respective connections of the control valve arrangement allocated to the control edges 26. Further, on the control side between the power pack 25 and the two assigned control edges 26 there is a flow line 29 that is used to connect the small cylinder capacity 20 and the large cylinder capacity 19 of the drive cylinder 12 via the switched control edges 26. Another connecting line between the reservoir 24 and the power pack 25 is planned in with the non-return valve 31 with a through flow direction from the reservoir 24 to the power pack 25.

FIGS. 2 to 6 present the switch conditions or fluid flows that occur during the operating modes.

As far as FIG. 2 shows the idle position of the mass body 10 before starting its movement phase, the piston flanges 33 of the piston slider 32 of the control valve 13 designed as a piston slider valve for the control cylinder 11 close the connecting lines 21 and 22 to the large cylinder capacity 19 and the small cylinder capacity 20 of the control cylinder 11, so that the control cylinder 11 is at a standstill. As can be seen from FIG. 2, the control valve arrangement 23 allocated to the drive cylinder 12 consists of three 2/2-way valves in the respective lines in form of cartridge valves connected into the lines. More specifically there is a 2/2-way valve 34 blocking the line path 27*a* to the reservoir 24, a 2/2-way valve 35 switched in the connection 27*b* between the large cylinder capacity 19 of the driver cylinder 12 and the power pack 25 and the flow rate line 29, and a 2/2-way valve 36 connected to the connecting line 28 between the small cylinder capacity 20 of the drive cylinder 12 and the power pack 25. The power pack 25 is charged with tensioned fluid, and all three 2/2-way valves 34, 35, 36 are in the closed position. As a result, the driver cylinder 12 is in idle position.

If the mass body 10 is to be moved to the right, then this will occur by activating the control valve 13 for the control cylinder 11, by displacing its piston slider 32 to the left, so that the piston flanges 33 will release the connection between the pump 14 and the line 21 leading to the large cylinder capacity 19 of the control cylinder 11, and at the same time the line 22 coming from the small cylinder capacity 13 is connected with the line 22*a*, leading from control valve 13 to the large cylinder capacity 19 of the control cylinder. This realizes the recovery feed control described in DE 10 2008 058 436 B3, as part of which the fluid displaced from the small cylinder capacity 20 of the control cylinder 11 is directly fed to its larger cylinder capacity 19. In this switch position of the control cylinder 11 its piston 17 is displaced to the right so that its piston rod 18 pushes the mass body 10. This switch position is reflected in FIG. 3.

At the same time for the valve arrangement 23 allocated to the drive cylinder 12, the two 2/2-way valves 35 and 36 are opened, so that on one hand the power pack 25 is connected to the large cylinder capacity 19 of the drive cylinder, and on the other hand during forward movement of the piston 17 in the drive cylinder 12 the fluid displaced from the small cylinder capacity is fed via line 28 and the flow line 29 into its large cylinder capacity 19. If the drive energy stored in the power pack 25 is consumed after concluding the acceleration phase, the control cylinder 11 will provide the power for moving the mass body 10 forward, whereby the fluid displaced from the small cylinder capacity 20 of the drive cylinder 12 flows into its large cylinder capacity 19.

If, after completing the movement phase, at the end of the movement of the mass body 10 to the right, there is a brake phase as seen in FIG. 4, then the connection between the large cylinder capacity 19 of the drive cylinder 12 and the power pack 25 is closed by closing the allocated 2/2-way valve 35, while simultaneously opening the connection from the large cylinder capacity 19 of the drive cylinder 12 to the reservoir 24 by opening the allocated 2/2-way valve 34. The 2/2-way valve 36 remains open. This switch position of the control valve arrangement 23 of the drive cylinder 12 results, at the time of switching over that the fluid displaced from the small cylinder capacity 20 of the drive cylinder 12 is fed into the power pack 25 and charges it. At the same time, the deficit of fluid created in the large cylinder capacity 19 of the drive cylinder 12 when continuing the forward drive of the mass body 10, is refilled by suction from the tank 24.

At the end of the brake phase, the control valve 13 for the control cylinder 11 and the control valve arrangement 23 for the drive cylinder 12 are put into the closed position, and the body is at idle or standstill as seen in FIG. 2.

Corresponding processes occur during the subsequent backward movement of the mass body 10, with the piston rods 18 of the control cylinder 11 and drive cylinder 12 retracting. As seen in FIG. 5, by moving the piston slider 32 with the piston flanges 33 of the control valve 13 for the control cylinder 11 to the right, pump 14 is connected to line 22 leading to the small cylinder capacity 20 of the control cylinder 11. On the other side a connection between the large cylinder capacity 19 of the control cylinder 11 and the reservoir 15 is made via the allocated line 21. Now the pump pressurizes the small cylinder capacity 20 of the control cylinder 11, thus moving the piston 17 of the control cylinder 11 to the left, while the fluid dispersed from the large cylinder capacity 19 flows into the reservoir 15. This moves the mass body 10 now to the left.

At the same time the connection between the power pack 25 and the small cylinder capacity 20 of the drive cylinder 12 is produced in the control valve arrangement 23 for the drive cylinder 12 by opening the applicable 2/2-way valve 36, and by opening the 2/2-way valve 34 the large cylinder capacity 21 of the drive cylinder 12 is connected with reservoir 24. The 2/2-way valve 35 remains closed. In this switch position of the control valve arrangement 23 the tensioned fluid is released from the power pack into the small cylinder capacity 20 of the drive cylinder 12, resulting in a respective acceleration of piston 17 of the drive cylinder 12 and thus the mass body 10 is moved to the left; the fluid dispersed here from the large cylinder capacity 19 flows into reservoir 24.

If at the end of this movement path of mass body 10 to the left there is a brake phase, then analog to the switch condition described in FIG. 4, according to FIG. 6 the 2/2-way valve 35 is opened and the 2/2-way valve 34 is closed so that the fluid dispersed from the large cylinder capacity 19 of the drive cylinder 12 flows via line 27 and the flow line 29 to the power pack 25 and charges it. A partial flow of the fluid is sucked via the opened 2/2-way valve 34 into the small cylinder capacity 20 of the drive cylinder 12 as long as the mass body 10 is still moving to the left.

At the end of the brake phase the control valve 13 as well as the control valve arrangement 23 are positioned in the completely closed position, so that the system is in the idle state as presented in FIG. 2.

As seen in FIG. 7 the invention can be applied to a construction of control cylinder 11 and drive cylinder 12 with one piston 17 each, and piston rods 18*a* and 18*b* attached on both sides, whereby the piston rod 18*a* is connected to the mass body 10, and the other piston rod 18*b* run empty. Since in this case the piston rods are of equal size, the applicable hydraulic switching will require an adjustment in so far that it is not required to have a recovery feed control at the control valve 13 for control cylinder 11, and instead is a reservoir connection 15*a* is allocated to the small cylinder capacity 19. As far as the same applies for the valve arrangement 23 of the drive cylinder 12 with an additional reservoir connection 24*a*, the control valve arrangement 23 has four control edges 26. The switching of the control edges 26 is identical to the one described in detail in FIGS. 2 to 6.

As it is already ascertained in the detailed functional description that the drive cylinder 12 is only necessary during the acceleration phase and the brake phase of the mass body 10, a practical embodiment of the invention is presented in FIG. 8, in which on both ends of the linear movement path of the mass body 10 one drive cylinder 12 *a* and one drive cylinder 12 *b* each are aligned. The piston rods 18 of the two drive cylinders 12*a* and 12*b* are accordingly designed short, so that starting from operating position presented in FIG. 8, after completing the acceleration phase, the mass body 10 lifts from the piston rod 18 of the drive cylinder 12*a*, and at the start of the brake phase meets the piston rod 18 of the opposing drive cylinder 12*b*. Both drive cylinders 12*a* and 12*b* are allocated hydraulic switches as described in FIG. 1, so that the switch processes are completed as described in detail in FIGS. 2 to 6.

In the practical embodiment depicted in FIG. 8, the drive cylinders 12*a* and 12*b* are each allocated to one power pack 25. To save on components and construction volume, in a manner not depicted, it can be planned that one common power pack 25 with corresponding feed lines is allocated to the two drive cylinders 12*a* and 12*b*. Changes in the function flow will not result.

The characteristics of the object of these documents, disclosed in this description, the patent claims, the summary and the drawing, can also be significant individually or in various combinations for realizing the invention in its various designs.

The invention claimed is:

1. A hydraulically driven arrangement for the linear movement of a mass body comprising first and second double acting operating cylinders each having a piston with a one-sided piston rod set up for interacting with the mass body in parallel relationship, the first operating cylinder being set up as a control cylinder for controlling the movement of the mass body in an acceleration phase, movement phase and brake phase, and the second operating cylinder being connected as a drive cylinder to a hydraulic power pack as an energy storage, such that the power pack during the acceleration phase of the mass body generates drive energy for the drive cylinder, and the drive cylinder in the brake phase of the mass body serves as a pump for charging the hydraulic power pack; and control circuits for controlling the control and drive cylinders by means of respective hydraulically separate and independent control valve arrangements, the control valve arrangement allocated to the drive cylinder having three control edges for connecting a small cylinder capacity of the drive cylinder with the power pack and a large cylinder capacity of the drive cylinder to the power pack, or a tank.

2. The hydraulically driven arrangement according to claim 1, wherein on both ends of the linear movement paths of the mass body, the drive cylinder with an allocated hydraulic control switch, is connected to the power pack and the tank, and where the piston rods facing the mass body only interact with it during the brake phase and the acceleration phase of the mass body, and the allocated piston rod of the control cylinder is coupled to it through the entire movement path of the mass body.

3. The hydraulically driven arrangement according to claim 2, wherein each of the two drive cylinders is allocated a controllable power pack via an interposed control valve arrangement.

4. The hydraulically driven arrangement according to claim 2, wherein the two drive cylinders are connected to a joint power pack via their allocated control valve arrangements.

5. The hydraulically driven arrangement according to claim 1, wherein the control valve arrangement for controlling the drive cylinder is designed by using in-line 2/2-way valves in the individual lines each leading into the cylinder capacities of the drive cylinder to the power pack and the tank.

6. The hydraulically driven arrangement according to claim 1, wherein the control valve arrangement for controlling the drive cylinder includes on one hand of the piston slide valve connected to its cylinder capacities on one hand and the tank and the power pack on the other hand.

7. A hydraulically driven arrangement for the linear movement of a mass body comprising two double acting operating cylinders each having a piston with a double-sided piston rod attached to the mass body in parallel relationship, one operating cylinder being established as a control cylinder for control of the mass body movement in an acceleration phase, a movement phase and a brake phase, and the other operating cylinder being connected as a drive cylinder to a hydraulic power pack as an energy saver such that the power pack during the acceleration phase of the mass body provides drive energy for the drive cylinder and the drive cylinder in the brake phase of the mass body serves as a pump for charging the hydraulic power pack, and the piston rods the control cylinder and drive cylinder are attached on both sides of the respective pistons for a symmetrical piston area, with one piston rod of each cylinder being coupled to the mass body for the back and forth movement of the mass body; and hydraulically separate and independent control valve arrangements for respectively controlling the control and drive cylinders, the control valve arrangement allocated to the drive cylinder having four control edges, and opposite sides of the piston of the drive cylinder being connected via the control valve arrangement to the power pack or the tank.

8. The hydraulically driven arrangement according to claim 7, wherein on the back stroke of the piston rods of the control cylinder and drive cylinder during the acceleration phase of the mass body, a connection between the large cylinder capacity of the drive cylinder and the tank is effected upon simultaneous blocking of a connection of the large cylinder capacity to the power pack, and a connection between the power pack and the small cylinder capacity of the drive cylinder is opened, so that the fluid released from the power pack charges the drive cylinder, and during the brake phase of the mass body the connection between the large cylinder capacity of the drive cylinder and the flow line with the attached power pack is open, while at the same time blocking a connection to the tank, so that the power pack is charged by the fluid dispersed from the larger cylinder capacity of the drive cylinder.

9. The hydraulically driven arrangement according to claim 1 or claim 7, in which cylinder capacities of the control cylinder are connected via the respective-hydraulic control valve arrangement with a pump and/or a tank.

10. The hydraulically driven arrangement according to claim 9, in which the hydraulic control valve arrangement has a recovery feed control for fluid dispersed during piston movement from the small cylinder capacity of the control cylinder.

11. The hydraulically driven arrangement according to claim 1 or claim 7, in which the cylinder capacities of the drive cylinder can be connected via the respective hydraulic control valve arrangement with the power pack and/or a tank.

12. The hydraulically driven arrangement according to claim 11, in which between the power pack and a connection with the allocated control edges of the respective control valve arrangement for the two cylinder capacities of the drive cylinder, a flow line is provided that connects the cylinder capacities of the drive cylinder.

13. The hydraulically driven arrangement according to claim 12, wherein during a forward stroke of the piston rods of the control cylinder and the drive cylinder during the acceleration phase of the mass body, the power pack is charged with fluid and the large cylinder capacity of the drive cylinder is opened via an allocated control edge of the respective control valve arrangement, and at the same time a connection between the small cylinder capacity of the drive cylinder and a flow rate line is opened, so that the fluid saved in the power pack and fluid dispersed during piston movement from the small cylinder capacity of the drive cylinder is injected into the large cylinder capacity of the drive cylinder, and wherein during the brake phase of the mass body on one hand a connection between the large cylinder capacity of the drive cylinder and the tank is opened and a connection between the flow rate line and the large cylinder capacity of the drive cylinder is blocked, and on the other hand a connection between the small cylinder capacity of the drive cylinder and the flow line remains open with the power pack, so that the power pack is charged by the fluid dispersed through the small cylinder capacity of the drive cylinder.

* * * * *